US006810930B2

(12) United States Patent
Schlipf et al.

(10) Patent No.: US 6,810,930 B2
(45) Date of Patent: Nov. 2, 2004

(54) APPARATUS FOR METERING POWDERED FILLING MATERIAL

(75) Inventors: Jens Schlipf, Freiberg A.N. (DE); Werner Runft, Winnenden (DE); Walter Boehringer, Remshalden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/382,517

(22) Filed: Mar. 7, 2003

(65) Prior Publication Data

US 2003/0197035 A1 Oct. 23, 2003

(30) Foreign Application Priority Data

Mar. 14, 2002 (DE) ..... 102 11 118

(51) Int. Cl.[7] ..... B67C 3/26; B67C 3/34

(52) U.S. Cl. ..... 141/258; 141/71; 141/79; 141/130; 141/181; 141/270; 141/284

(58) Field of Search ..... 141/69, 71, 79, 141/81, 129, 130, 144, 146, 148, 181, 250, 258, 270, 284; 222/275, 367, 370, 344, 346

(56) References Cited

U.S. PATENT DOCUMENTS

| | | | | | |
|---|---|---|---|---|---|
| 4,501,307 | A | * | 2/1985 | Moser et al. | 141/258 |
| 4,949,766 | A | * | 8/1990 | Coatsworth | 141/67 |
| 5,626,171 | A | * | 5/1997 | Mirri | 141/152 |
| 5,855,233 | A | * | 1/1999 | Bolelli | 141/144 |

* cited by examiner

*Primary Examiner*—Timothy L. Maust
(74) *Attorney, Agent, or Firm*—Ronald E. Greigg

(57) ABSTRACT

An apparatus for metering powdered filling material has a filling material container whose bottom is provided with bores which cooperate with tamping plungers and transfer plungers. Underneath the bottom is a stop ring which functions as a counter support for the tamping plungers. To prevent powder losses from the bottom the filling material container is axially movable in such a way that it can be pressed against the stop ring during the downward motion of the tamping plungers. This is achieved by means of hold-down elements which can be moved synchronously with the tamping plungers.

20 Claims, 1 Drawing Sheet

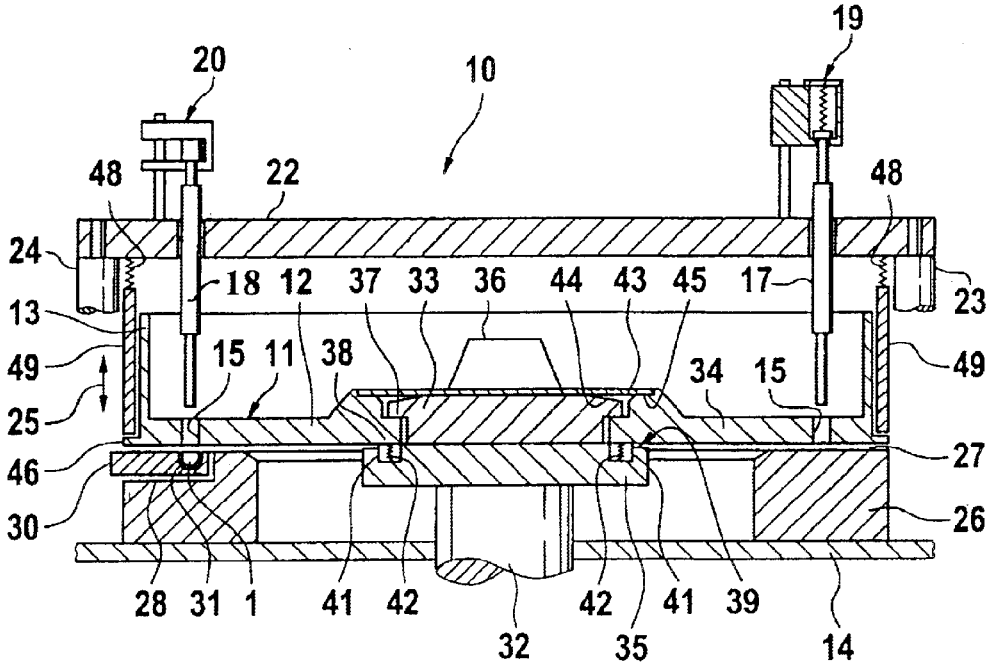
19
20
10
48
22
48
24
18
12
37
33
36
44
43
45
17
23
13
15
11
38
34
15
49
49
25
27
46
30
26
28
31
1
41
42
32
42
35
41
39
14

APPARATUS FOR METERING POWDERED FILLING MATERIAL

BACKGROUND OF THE INVENTION

1. Field of the Invention

The invention relates to an apparatus for metering powdered filling material and more particularly for dispensing such materials for filling capsules or the like.

2. Description of the Prior Art

One known apparatus of the type with which this invention is concerned is disclosed in DE 31 10 483 A1 which describes the apparatus as including the provision that adjusting means are used to press the stop ring against the underside of the metering disk. No further details of this are given. The stop ring is pressed against the underside of the metering disk in order to prevent powder from escaping from the through openings into the gap between the underside of the metering disk and the stop ring during the insertion of the tamping plungers into the openings of the metering disk. Such powder losses are undesirable first, because the escaping powder contaminates the apparatus, and second because the powder loss represents a not so insignificant cost factor, particularly with relatively costly pharmaceuticals. It would therefore be desirable to produce an apparatus that prevents powder losses during insertion of the tamping plungers into the openings of the filling material container; the apparatus should function with a high degree of operational reliability and should at the same time also be relatively simple in design.

OBJECT AND SUMMARY OF THE INVENTION

The apparatus for metering powdered filling material according to the invention has the advantage that it functions in a particularly operationally reliable and low-friction manner due to the spring means, which hold the metering disk a definite distance away from the stop ring during its rotation, and that it is also relatively simple in design due to the stationary disposition of the stop ring, which consequently does not require any moving mechanism.

Other advantageous modifications of the apparatus for metering powdered filling material according to the invention are disclosed. A structurally simple, advantageous embodiment of the relative mobility between the metering disk and the stop ring is achieved by virtue of the fact that the filling material container has a central region and an outer region, which are connected to each other in such a way that they do not rotate in relation to each other, but can be moved axially in relation to each other. Preferably this embodiment is covered by an elastic covering element in the filling material container, which prevents powder from getting into the transition region between the central region and the outer region of the filling material container.

A compact embodiment of the invention can be achieved if the spring means, which hold the metering disk spaced apart from the stop ring, are integral to the axle journal that drives the metering disk.

In a preferred embodiment, the filling material container is pressed down against the stop ring by means of a rib, which is situated outside the boundary wall of the filling material container. This prevents the mechanism for pressing down the filling material container from coming into contact with the filling material contained in the filling material container.

The press-down mechanism for the filling material container can be embodied in a simple way if it is attached to a support on which the tamping plungers are also disposed. As a result, the press-down element, which presses the filling material container against the stop ring, is automatically moved along with the downward motion of the tamping plungers.

BRIEF DESCRIPTION OF THE DRAWINGS

The invention will be better understood and further objects and advantages thereof will become more apparent from the ensuing detailed description of preferred embodiments taken in conjunction with the drawings, in which the sole figure shows a simplified longitudinal section through an apparatus according to the invention for metering powdered filling material.

DESCRIPTION OF THE PREFERRED EMBODIMENTS

The apparatus 10 for metering powdered filling material shown in the figure is used in the pharmaceutical industry to produce drug-filled hard gelatin capsules. The apparatus 10 has a filling material container 11 for the filling material, which has an essentially disk-shaped bottom 12 and an outer, vertically extending boundary wall 13. At uniform angular intervals, the bottom 12 contains bores 15 or groups of bores, which cooperate with tamping plungers 17 and transfer plungers 18. The tamping plungers 17 and the transfer plungers 18 are supported in spring-loaded tamping plunger supports 19 and transfer plunger supports 20, which are in turn jointly attached to a lateral cross bar 22. The lateral cross bar 22 is supported on columns 23, 24 and can move up and down in the direction of the arrow 25.

Underneath the bottom 12 of the filling material container 11, in its outer region, a stop ring 26 is disposed on the tabletop 14 of the apparatus 10; between the underside of the bottom 12 and the associated top of the stop ring 26, there is a gap 27 in the neighborhood of a few tenths of a millimeter in size. In the vicinity of the transfer plungers 18, the stop ring 26 has a recess 28, which permits the capsule part carrier 30, which is only partially depicted in the figure, to pivot into place.

Congruent with the bores 15, the capsule part carrier 30 has recesses 31 for the capsule bottoms 1, which are a component of the hard gelatin capsules mentioned above.

The apparatus 10 described thus far is already known. In order to meter the filling material into the capsule bottoms 1, a drive shaft 32 coupled to a motor, not shown, rotates the filling material container 11 incrementally under the respective tamping plungers 17 and transfer plungers 18. While the filling material container 11 is at rest, powder situated in the vicinity of the bores 15 is pressed into the bores 15 by means of a downward motion of the tamping plungers 17, the stop ring 26 acting as an opposing support. In the vicinity of the transfer plungers 18, in which the stop ring 26 is recessed as described above, the downward motion of the transfer plungers 18 transfers the compressed powder pellet into the respective capsule bottom 1. Then the capsule part carrier 30 pivots all of the filled capsule bottoms 1 away from the region of the filling material container 11 in order to place the corresponding capsule tops onto the capsule bottoms 1.

Because of the gap 27 between the bottom 12 of the filling material container 11 and the stop ring 26, the tamping plunger pressure causes powder losses, particularly while the tamping plungers 17 are being lowered into the bores 15. This powder escapes from the bores 15 into the gap 27 and from there, is scattered over the stop ring 26 and the entire apparatus 10. The apparatus 10 according to the invention is particularly designed to prevent or reduce these powder losses.

The bottom 12 has two regions, an inner, raised central region 33 and an outer, annular region 34. The central region 33 is attached to a connecting flange 35 of the drive shaft 32; the region of this attachment is covered by a cap 36. The central region 33 and the outer region 34 of the bottom 12 are connected to each other so that they can move axially in relation to each other, but cannot rotate in relation to each other. This can be achieved, for example, by means of a feather key connection between the two regions 33, 34.

On its side oriented toward the connecting flange 35, the central region 33 has an annular step 37 in which a corresponding section 38 of the outer region 34 engages. The step 37 consequently functions as an upper stop for the outer region 34 in order to limit its axial motion. In the vicinity of the section 38 and the outer region 34 of the bottom 12, the thickness of the connecting flange 35 is reduced somewhat so that a gap 39 is left between the connecting flange 35 and the outer region 34. In addition, congruent with the outer region 34, a number of recesses 41 are embodied at uniform angular intervals in the connecting flange 35 and contain compression springs 42. The compression springs 42 press the outer region 34 of the bottom 12 toward the step 37 of the central region 33, thus producing the gap 39 mentioned above. In addition, the top of the central region 33 is also covered by a relatively thin covering element 43, which projects over the connecting point between the central region 33 and the outer region 34 of the bottom. So that no gap is produced between the central region 33 and the outer region 34 when the outer region 34 moves in relation to the central region 33, the central region 33 also has a bevel 44 in the vicinity of the covering element 43 and the outer region 34 has a recess 45 in which the circular, flexible covering element 43 is fastened.

The outer region 34 of the bottom 12 is embodied so that it extends beyond the boundary wall 13, thus producing a shoulder 46, which is still disposed within the region of the stop ring 26. In the exemplary embodiment shown, this shoulder 46 cooperates with two hold-down elements 49 that are each spring-loaded by a compression spring 48. In this connection, it is essential that the compression springs 48 associated with the hold-down elements 49 have a greater spring hardness than the compression springs 42 in the connecting flange 35. The compression springs 48 and hold-down elements 49 are attached to the underside of the lateral cross bar 22 and can be moved up and down synchronously with it and with the tamping plungers 17 and transfer plungers 18.

The embodiment according to the invention of the filling material container 11 and the hold-down elements 49 assures that when the tamping plungers 17 and transfer plungers 18 are moved downward, the hold-down elements 49 simultaneously press the outer region 34 of the filling material container 11 downward against the stop ring 26. This reduces to zero the gap 27, which must otherwise be present in order to reduce friction during rotation of the filling material container 11, so that particularly when the tamping plungers 17 are inserted into the bores 15, no powder can escape from the underside of the outer region 34 of the filling material container 11.

When the tamping plungers 17 lift out from the bores 15, the hold-down elements 49 also lift up from the shoulder 46 so that the compression springs 42 once again push the outer region 34 of the filling material container 11 upward against the step 37 of the central region 33 so that the gap 39 is reinstated.

The apparatus 10 according to the invention can be modified in numerous ways without going beyond the concept of the invention, which is comprised of pressing the filling material container against the stop ring during the metering of the filling powder into the bores so that no powder can escape from the underside of the filling material container. This is achieved according to the invention through a flexible support or suspension of the filling material container in cooperation with hold-down elements. Thus it is conceivable, for example, to use a single annular hold-down element in lieu of the two hold-down elements that are described above and shown in the drawing. In addition, tamping plungers, transfer plungers, and hold-down elements can be driven by various actuating elements.

The foregoing relates to preferred exemplary embodiments of the invention, it being understood that other variants and embodiments thereof are possible within the spirit and scope of the invention, the latter being defined by the appended claims.

We claim:

1. An apparatus (10) for metering powdered filling material, in particular pharmaceuticals, comprising a filling material container (11) supported for rotation about a vertical axis and having a bottom (12) provided with openings (15)

tamping plungers (17) supported for insertion with the openings (15)

a stationary stop ring (26), disposed congruent with the openings (15)

means (32) rotating the filling material container (11) in incremental steps the stop ring (26) being disposed spaced slightly apart from the underside of the filling material container (11) oriented away from the tamping plungers (17) during rotation of the filling material container (11)

means operable to press the stop ring (26) and the filling material container (11) against each other in order to prevent powder losses, spring means (42) operable to move the filling material container (11) into a position spaced apart from the stop ring (26) during the rotating motion of the filling material container (11), and means (48, 49) pressing the filling material container (11) against the stationary stop ring (26) in opposition to the spring means (42) when the filling material container (11) is at rest.

2. The apparatus according to claim 1, wherein the filling material container (11) comprises a central middle region (33), which is fastened to an axle journal (35) coupled to the drive of the filling material container (11), wherein the middle region (33) is encompassed by an annular outer region (34), which cooperates with the spring means (42), and wherein the middle region (33) and the outer region (34) are supported for axial movement in relation to each other, but cannot rotate in relation to each other.

3. The apparatus according to claim 2, further comprising an elastic covering element (43) inside the metering container (11) covering at least the transition region between the middle region (33) and the outer region (34).

4. The apparatus according to claim 2, wherein the spring means (42) are integrated into at least one recess (41) of the axle journal (35).

5. The apparatus according to claim 3, wherein the spring means (42) are integrated into at least one recess (41) of the axle journal (35).

6. The apparatus according to claim 1, wherein the filling material container (11) comprises an outside circumferential, vertically oriented boundary wall (13), and a circumferential rib (46) which cooperates with at least one hold-down element (49).

7. The apparatus according to claim 2, wherein the filling material container (11) comprises an outside circumferential, vertically oriented boundary wall (13), and a circumferential rib (46) which cooperates with at least one hold-down element (49).

8. The apparatus according to claim 3, wherein the filling material container (11) comprises an outside circumferential, vertically oriented boundary wall (13), and a circumferential rib (46) which cooperates with at least one hold-down element (49).

9. The apparatus according to claim 4, wherein the filling material container (11) comprises an outside circumferential, vertically oriented boundary wall (13), and a circumferential rib (46) which cooperates with at least one hold-down element (49).

10. The apparatus according to claim 6, wherein the at least one hold-down element (49) is attached to a support (22), which can move up and down and from which the tamping plungers (17) are also suspended.

11. The apparatus according to claim 7, wherein the at least one hold-down element (49) is attached to a support (22), which can move up and down and from which the tamping plungers (17) are also suspended.

12. The apparatus according to claim 8, wherein the at least one hold-down element (49) is attached to a support (22), which can move up and down and from which the tamping plungers (17) are also suspended.

13. The apparatus according to claim 9, wherein the at least one hold-down element (49) is attached to a support (22), which can move up and down and from which the tamping plungers (17) are also suspended.

14. The apparatus according to claim 6, wherein on its underside, the rib (46) ends flush with the underside of the filling material container (11) and wherein the rib (46) is disposed congruent to the stop ring (26).

15. The apparatus according to claim 7, wherein on its underside, the rib (46) ends flush with the underside of the filling material container (11) and wherein the rib (46) is disposed congruent to the stop ring (26).

16. The apparatus according to claim 8, wherein on its underside, the rib (46) ends flush with the underside of the filling material container (11) and wherein the rib (46) is disposed congruent to the stop ring (26).

17. The apparatus according to claim 9, wherein on its underside, the rib (46) ends flush with the underside of the filling material container (11) and wherein the rib (46) is disposed congruent to the stop ring (26).

18. The apparatus according to claim 11, wherein on its underside, the rib (46) ends flush with the underside of the filling material container (11) and wherein the rib (46) is disposed congruent to the stop ring (26).

19. The apparatus according to claim 12, wherein on its underside, the rib (46) ends flush with the underside of the filling material container (11) and wherein the rib (46) is disposed congruent to the stop ring (26).

20. The apparatus according to claim 13, wherein on its underside, the rib (46) ends flush with the underside of the filling material container (11) and wherein the rib (46) is disposed congruent to the stop ring (26).

* * * * *